United States Patent [19]

Bengston

[11] Patent Number: 5,051,016

[45] Date of Patent: Sep. 24, 1991

[54] DEODORANT ANTIPERSPIRANT CAP ACTIVATED WIDE-ROLL-ON

[75] Inventor: John A. Bengston, Ridgefield, Conn.

[73] Assignee: Chesebrough-Pond's USA Co., Division of Conopco, Inc., Greenwich, Conn.

[21] Appl. No.: 523,834

[22] Filed: May 15, 1990

Related U.S. Application Data

[63] Continuation of Serial No. 253,256, Oct. 4, 1988 abandoned.

[51] Int. Cl.[5] ..... A45D 34/04

[52] U.S. Cl. ..... 401/213; 401/208; 401/219; 401/220

[58] Field of Search ..... 401/213, 208, 219, 220, 401/214

[56] References Cited

U.S. PATENT DOCUMENTS

| | | | |
|---|---|---|---|
| Re. 18,649 | 11/1932 | Kalb . | |
| Re. 25,380 | 5/1963 | Ackerman . | |
| 146,183 | 1/1874 | Inglis et al. . | |
| 741,147 | 10/1903 | LaBur et al. . | |
| 753,593 | 3/1904 | Langill . | |
| 1,714,030 | 5/1929 | LeBoeuf . | |
| 1,958,430 | 5/1934 | Hartog . | |
| 1,958,431 | 5/1934 | Hartog . | |
| 2,331,672 | 10/1943 | Falkman . | |
| 2,669,740 | 2/1954 | Main . | |
| 2,749,566 | 6/1956 | Thomas . | |
| 2,823,403 | 2/1958 | Whitney . | |
| 2,904,810 | 9/1959 | Dence et al. . | |
| 2,910,712 | 11/1959 | Schaich et al. . | |
| 2,923,957 | 2/1960 | Gentile . | |
| 2,937,391 | 5/1960 | Phillips . | |
| 2,968,826 | 1/1961 | Leshin . | |
| 2,976,561 | 3/1961 | Culver . | |
| 2,981,968 | 5/1961 | Schaich . | |
| 3,036,328 | 5/1962 | Schaich . | |
| 3,039,132 | 6/1962 | Hambley . | |
| 3,069,718 | 12/1962 | Brady et al. . | |
| 3,075,230 | 1/1963 | Marchant . | |
| 3,095,598 | 7/1963 | Gonnella et al. . | |
| 3,111,703 | 11/1963 | Kaufman . | |
| 3,134,131 | 5/1964 | Thomas . | |
| 3,263,265 | 8/1966 | Judson | 401/220 X |
| 3,426,949 | 2/1969 | James . | |
| 3,885,712 | 5/1975 | Libit . | |
| 4,168,128 | 9/1979 | Fillmore et al. . | |
| 4,221,494 | 9/1980 | Kachur . | |
| 4,629,097 | 12/1986 | Moore . | |
| 4,690,304 | 9/1987 | Morel . | |
| 4,723,860 | 2/1988 | Giblin et al. . | |

FOREIGN PATENT DOCUMENTS

| | | | |
|---|---|---|---|
| 270136 | 11/1950 | Switzerland | 401/213 |

*Primary Examiner*—Steven A. Bratlie

*Attorney, Agent, or Firm*—Brumbaugh, Graves, Donohue & Raymond

[57] ABSTRACT

A wide roll on product dispenser is provided with a valve mechanism which is operated by movement of the roller using toward and away from the fluid reservoir. In a preferred arrangement the housing mechanism is moved by applying and removing a roller overcover.

6 Claims, 2 Drawing Sheets

DEODORANT ANTIPERSPIRANT CAP ACTIVATED WIDE-ROLL-ON

This application is a continuation of application Ser. No. 253,256, filed on Oct. 4, 1988, now abandoned.

BACKGROUND OF THE INVENTION

The present invention relates to roll-on liquid product dispensers and particularly to such dispensers having an elongated roller. In particular the present invention is directed to a roll-on liquid product dispenser having an improved sealing arrangement.

In connection with roll-on dispensers having spherical rollers mounted in a socket, sealing of the container is frequently accomplished by providing an overcap that forces the spherical roller into the socket to seal a fluid opening at the base of the socket. Alternately there may be provided an overcap which sealingly engates the container around the socket.

This type of seal arrangement has been applied to wide roll on dispenses having an elongated roller, but the variation in shape between an eliptical roller and the sealing surfaces of the fluid opening can make effective sealing difficult. Likewise, it is difficult to obtain a good seal between an oval overcap and an oval container.

U.S. Pat. No. 4,723,860 shows an arrangement for a wide roll-on dispenser having a valve member positioned between the roller and the fluid opening. The valve member is biased by a spring into a closed position and opened by pressure from downward movement of the roller. This arrangement require significant force by the user on the roller to initiate and continue fluid flow during use.

It is therefore an object of the present invention to provide a new and improved roll-on dispenser with an improved sealing arrangement.

It is a further object of the invention to provide a roll-on dispenser with a sealing arrangement which automatically opens upon removal of the overcap and automatically closes upon replacement of the overcap.

SUMMARY OF THE INVENTION

In accordance with the present invention there is provided a liquid product dispenser which includes a liquid product dispenser which includes a liquid reservoir having a liquid outlet passage and a first valve member in the passage having a fixed relation to the reservoir. The dispenser further includes an applicator assembly which has a rotatable applicator roller mounted to a supporting housing. The housing includes a fluid passage for conducting fluid to the roller and an inlet passage mounted to the liquid outlet passage of the reservoir for receiving fluid therefrom and including a second valve member. The second valve member is movable with respect to the first valve member to open and close the passage.

In a preferred embodiment the second valve member is fixed with respect to the applicator assembly housing and the frame moves towards and away from the reservoir to close and open the passage. The movement towards and away from the reservoir may be activated by applying and removing an overcap.

For a better understanding of the present invention, together with other and further objects, reference is made to the following description, taken in conjunction with the accompanying drawings and its scope will be pointed out in the appended claims.

DESCRIPTION OF THE INVENTION

Figure 1:
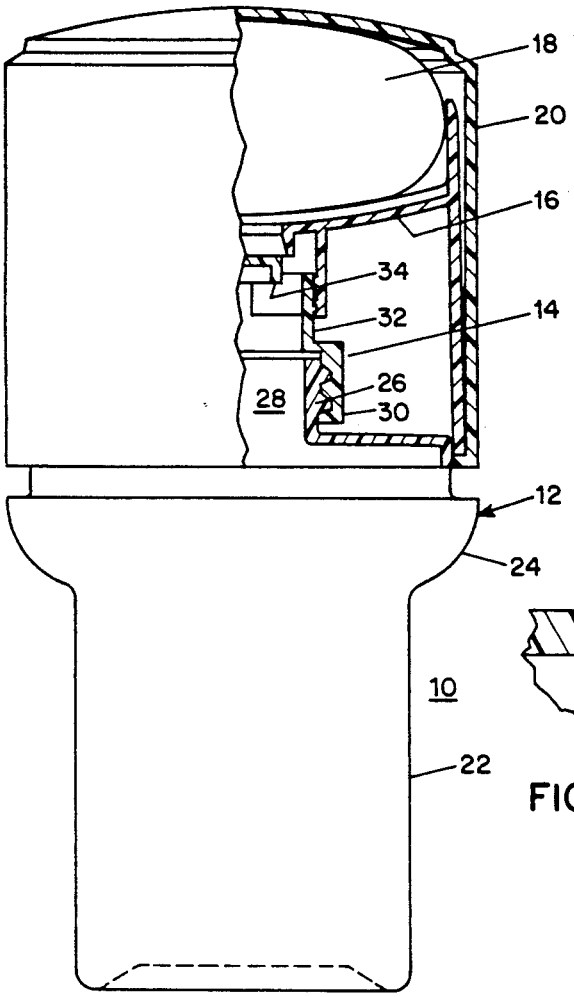
FIG. 1 is a partially cross-sectioned plan elevation view of a roll-on fluid dispenser in accordance with the present invention.

A preferred embodiment of the present invention is shown in FIG. 1, which shows a wide bodied roll-on dispenser including a fluid bottle 12, a first valve member 14, an applicator assembly comprising a housing member 16 and roller 18 mounted thereon and an overcap 20.

Bottle 12 is molded of conventional flexible plastic material and includes a generally cylindrical or elliptical lower portion 22 and an upper portion 24 which is extended in one longitudinal direction to conform to the elongated shape of roller 18. Bottle 12 includes a cylindrical neck 26 with a central outlet passage 28 and exterior threads.

Figure 5:
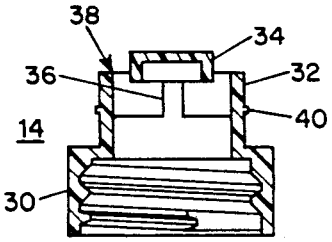
FIGS. 5 and 5B are cross-sectional views of the first valve member used in the FIG. 1 dispenser.
Figure 6:
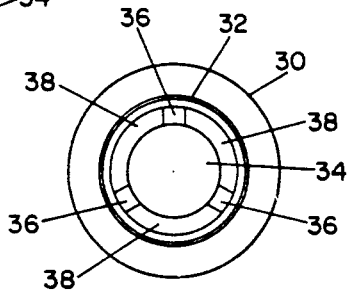
FIG. 6 is a top view of the FIG. 5 valve member.

First valve member 14 is screwed onto neck 26 by its lower portion 30 which is provided with internal threads to mate to the threads on neck 26. The upper portion of valve member 14 includes a cylindrical portion 32 and a valve plug 34, which are shown in greater detail in FIGS. 5 and 6. Cylindrical portion 32 includes an outwardly facing rib 40 which is designed to interact with inwardly facing ribs which are provided on housing member 16 as will be further described. Valve member 34 is supported by struts 36 which leave an open area between plug 34 and cylindrical member 32 for passage of fluid when the valve is open.

Figure 5B:
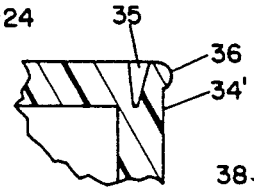

FIG. 5B shows a modified edge for valve plug 34 wherein there is provided an annular groove on the upper surface of plug 34 and an outwardly facing ridge 36. The combination of groove 35 and ridge 36 provided flexibility of the edge of plug 34 to provide a more effective sealing of the plug to the mating valve member, which has an inwardly facing conical surface as will be described.

Figure 2:
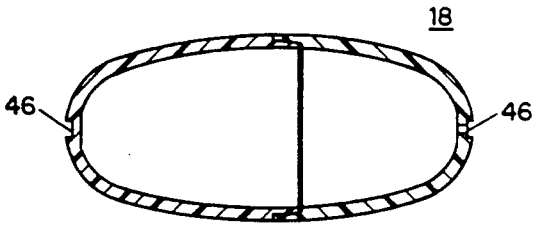
FIG. 2 is a cross-sectional view of the roller used in the FIG. 1 dispenser.
Figure 3A:
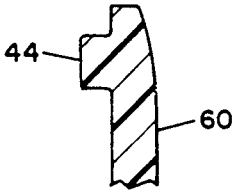
FIG. 3, 3A and 3B are longitudinal cross-sectional views of the housing member used in the FIG. 1 dispenser.
Figure 3:
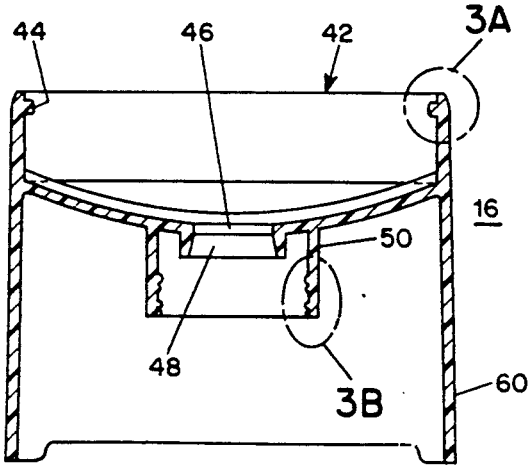
Figure 3B:
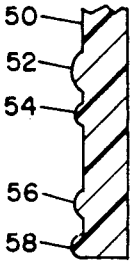
Figure 4:
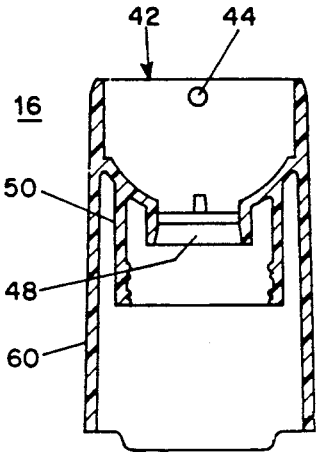
FIG. 4 is a transverse cross-sectional view of the housing member used in the FIG. 1 dispenser.

Housing member 16 is shown in cross-sectional views in FIGS. 3 and 4. As shown in FIG. 3 housing member 16 includes an upwardly facing socket portion 42 having at its ends inwardly facing projections 44 which can be received in bores 46 provided at either end of elliptical roller 18, as shown in FIG. 2, so that roller 18 is free to rotate about its central elongated axis within socket portion 42. The base of socket portion 42 includes a fluid inlet 46 which is provided with a second valve member 48 having an inner conical shaped surface for receiving and engaging valve plug 34 on valve member 14. Surrounding valve member 48 there is provided a cylindrical portion 50 which has an inner cylindrical surface provided with ridges 52, 54, 56 and 58 as shown in FIG. 3B. Cylindrical portion 50 is of a size which is selected to receive cylindrical portion 32 of valve member 14 in close fitting relation. Ridge 40 on cylindrical portion 32 is designed to interact with ridges 52, 54, 56 and 58 on cylindrical portion 50 such that when housing member 16 is mounted onto valve member 14 and pressed downwardly the lower ridge 58 of cylindrical portion 50 passes over ridge 40 and thereby locks housing member 16 onto valve member 14. Ridges 56 and 58 provide locking positions for the open and closed position of the valve formed by plug 34 and second valve member 48. Ridge 52 prevents excess downward movement of cylindrical member 50 onto cylindrical member 32. Housing member 16 further includes a housing skirt 60 which is arranged to surround a portion of the upper part of bottle 12 to provide rotational stability to housing 16 and also to esthetically conceal the valve mechanism in the final package.

Those familiar with the art will recognize that the valve members can be interchanged so that plug 34 may be on housing 16 and conical valve surface 48 may be on valve member 14.

Figure 7:
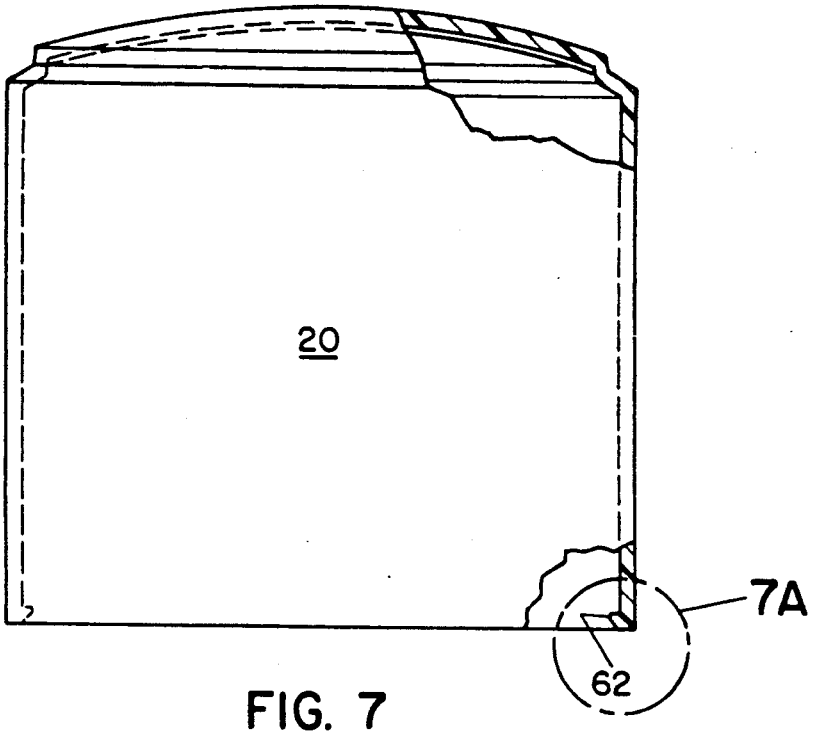
FIGS. 7 and 7A are partially cross-sectional plan elevation views of the overcap of the FIG. 1 dispenser.
Figure 7A:
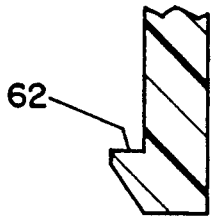

Overcap 20 is shown in FIG. 7 and includes an esthetically designed cap to cover roller 18 and housing member 16. The cap is designed with an inwardly facing rib 62 at the longitudinal ends of its lower edge in the form of an arc which crosses the end of the oval opening. Ridge 62 is positioned so that as the upper portion of overcap 20 contacts roller 18 ridge 62 locks beneath skirt 60 of housing member 16 as shown in FIG. 1.

The invention as describes provides a package assembly which facilitates filling the container and assembly of the package and which also provides a leak-proof packaging for the product which can be opened automatically and closed by removal and replacement of the overcap. In connection with filling of bottle 12 fluid may be added to the interior of the bottle prior to the assembly of valve member 14 to the threaded neck 26 of bottle 12. After the fluid filling, valve member 14 is screwed onto the bottle neck 12. Thereafter housing member 16, which has previously been provided with roller 18 snapped into position over projections 44 is applied to the valve member so that cylindrical portion 50 slides down and over cylindrical portion 32 whereby ridges 40 and 52, 54, 56, and 58 interact to provide a locking of housing 16 onto valve member 14. As the housing member is pushed to its lower most position whereby ridge 40 is adjacent ridge 52 valve plug 34 moves into position within conical second valve member 48 whereby the edges of plug 34 seal against the conical surface 48 to seal the container closed. Overcap 20 is then applied to the package. When the package is to be used by a consumer the consumer will remove overcap 20 generally by grasping it along it longitudinal sides such that the longitudinal ends having ridge 62 are moved slightly outward. The locking between ridge 62 and housing 16 will cause housing 16 to move in an upward direction as the overcap 20 is removed until stopped by ridges 56 or 58, thereby moving first valve member comprising plug 34 away from the second valve member comprising conical surface 48 and thereby opening a passage from the fluid bottle 12 into the socket portion 42 of housing member 16 whereby the fluid can be applied to roller 18. Continued upward pulling of the overcap 20 causes ridges 62 to release from the skirt 60 of housing members 16 so that the overcap can be completely removed and the applicator is ready for use.

Upon completion of use the overcap 20 is applied over roller 18 and housing member 16 whereby the top of overcap 20 engages roller 18 and upon continued placement of the overcap onto the container roller 18 pushes housing member 16 downwardly thereby to close the valve formed by plug 34 and conical surface 48. Simultaneously ridge 62 locks beneath skirt 60 of housing member 16 thereby to be prepared for opening the container upon subsequent removal of the overcap 20.

While there has been described what is believed to be the preferred embodiment of the invention, those skilled in the art will recognize that other and further modifications may be made thereto without departing from the spirit of the invention, and it is intended to claim all such changes and modifications as fall within the true scope of the invention.

I claim:

1. A roll-on fluid product dispenser, comprising:

a bottle member, including a fluid reservoir and a fluid outlet opening, said fluid outlet opening including a first valve member in fixed relation to said fluid reservoir, said bottle member having a non-circular cross-section in the region adjoining said fluid outlet opening:

an applicator assembly comprising a housing and an elongated roller mounted rotationally in a fixed position with respect to a socket portion of said housing, said socket portion including closed socket walls surrounding a lower portion of said roller and a single fluid inlet passage in communication with the interior of said socket portion and said fluid outlet opening of said bottle member, for receiving fluid therefrom and for conveying said fluid to said roller, said housing including a second valve member in fixed position with respect to said socket portion for operating in cooperation with the first valve member to form a seal between the fluid outlet opening and said single fluid inlet passage in a first position when said applicator assembly is moved toward said fluid reservoir, and to open said seal in a second position when said applicator assembly is moved away from said fluid reservoir, said applicator assembly including a non-circular skirt surrounding said non-circular region of said bottle for guiding said movement toward and away from said bottle member, and said fluid inlet including an inlet member closely engaging said fluid outlet opening of said bottle to form a closed fluid passage, said inlet member and said fluid outlet opening including interacting ridges for limiting movement of said applicator assembly.

2. A product dispenser as specified in claim 1 wherein said roller is rotationally mounted by pivot connections to said housing at each of its elongate end points.

3. A product dispenser as specified in claim 1 wherein one of said valve members comprises a conical surface and the other of said valve members is circular.

4. A product dispenser as specified in claim 1 wherein there is provided an overcap for covering said roller and wherein said overcap is arranged to engage said applicator assembly to move said applicator assembly toward said fluid reservoir when said overcap is applied and to pull said applicator assembly away from said fluid reservoir when said overcap is removed.

5. A product dispenser as specified in claim 4 wherein said overcap pushes said roller toward said reservoir when said overcap is applied.

6. A product dispenser as specified in claim 5 wherein said overcap has a lower edge with at least one inwardly projecting rib, and wherein said rib engages a portion of said housing to move said housing away from said reservoir when said overcap is removed.

* * * * *